US006557866B2

(12) United States Patent
Jones et al.

(10) Patent No.: US 6,557,866 B2
(45) Date of Patent: May 6, 2003

(54) SNOWBOARD BINDING

(76) Inventors: Dennis Jones, 22707 Copper Hill Dr. #32, Saugus, CA (US) 91350; Jason Englehart, 1500 Mesa Verde, Farmington, NM (US) 87401

( * ) Notice: Subject to any disclaimer, the term of this patent is extended or adjusted under 35 U.S.C. 154(b) by 0 days.

(21) Appl. No.: 09/804,539

(22) Filed: Mar. 9, 2001

(65) Prior Publication Data

US 2002/0125687 A1 Sep. 12, 2002

(51) Int. Cl.[7] ..... A63C 9/00

(52) U.S. Cl. ..... 280/14.22; 280/14.24; 280/613; 280/618

(58) Field of Search ..... 280/14.21, 14.22, 280/14.24, 613, 616, 617, 618

(56) References Cited

U.S. PATENT DOCUMENTS

| | | | | | |
|---|---|---|---|---|---|
| 4,008,901 | A | * | 2/1977 | Conn | 280/11.3 |
| 5,035,443 | A | | 7/1991 | Kincheloe | 280/618 |
| 5,354,088 | A | * | 10/1994 | Vetter et al. | 280/14.22 |
| 5,505,478 | A | * | 4/1996 | Napoliello | 280/14.22 |
| 5,695,210 | A | * | 12/1997 | Goss et al. | 280/14.23 |
| 5,704,139 | A | | 1/1998 | Okajima | 36/115 |
| 5,890,730 | A | | 4/1999 | Anderson et al. | 280/624 |
| 5,906,388 | A | * | 5/1999 | Neiley | 280/14.22 |
| 5,971,420 | A | | 10/1999 | Okajima et al. | 280/613 |
| 5,984,324 | A | * | 11/1999 | Wariakois | 280/14.24 |
| 6,007,085 | A | | 12/1999 | Rigal et al. | 280/607 |
| 6,010,138 | A | | 1/2000 | Bobrowicz et al. | 280/11.36 |
| 6,022,040 | A | * | 2/2000 | Buzbee | 280/607 |
| 6,193,245 | B1 | * | 2/2001 | Vensel | 280/14.22 |
| 6,196,559 | B1 | * | 3/2001 | Cress | 280/14.22 |
| 6,209,890 | B1 | * | 4/2001 | Couderc | 280/14.22 |
| 6,315,318 | B1 | * | 11/2001 | Caron et al. | 280/607 |

* cited by examiner

*Primary Examiner*—Robert P. Olszewski
*Assistant Examiner*—James S. McClellan
(74) *Attorney, Agent, or Firm*—Christie, Parker & Hale, LLP

(57) ABSTRACT

A snowboard binding for use with a snowboard and boots. The snowboard binding includes a top plate for affixation to a sole of a boot and a bottom plate for affixation to a snowboard. The top plate has two spaced apart and opposed upturned and inwardly angled end walls, and a locking bar with a hole formed therein. The bottom plate has two opposing end tabs which are inwardly angled by a predetermined angle generally mating to that of the end walls of the top plate. The bottom plate has a locking mechanism with a locking pin adapted to be biased into a hole formed in the locking bar when the top plate is fully engaged with the bottom plate.

17 Claims, 6 Drawing Sheets

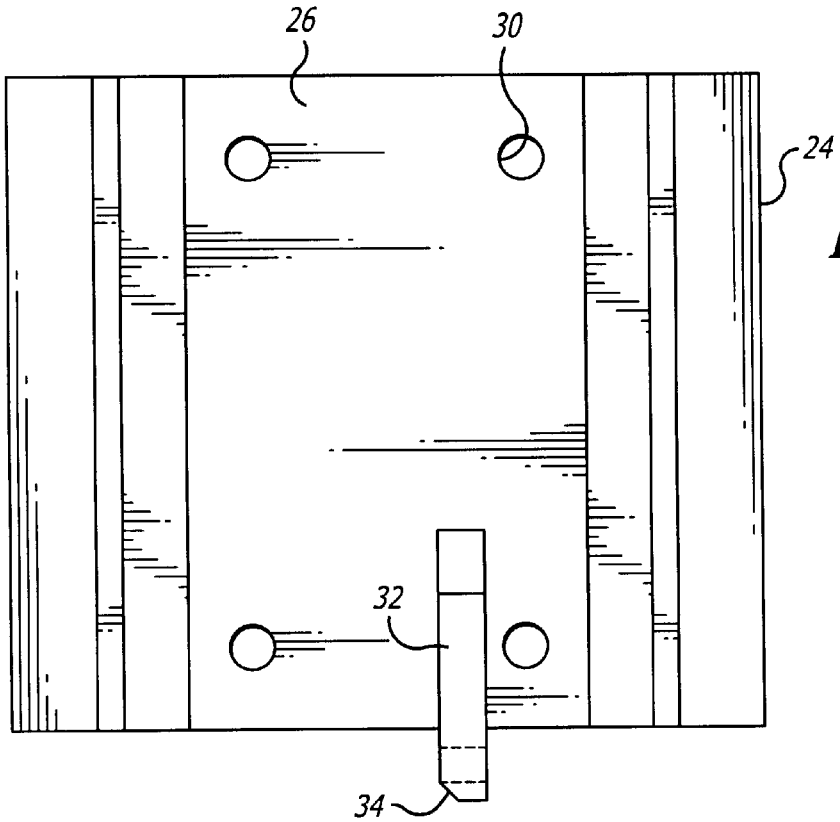
FIG. 5
FIG. 6
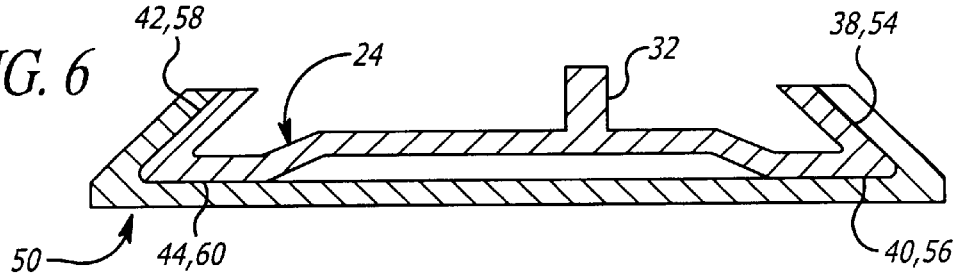
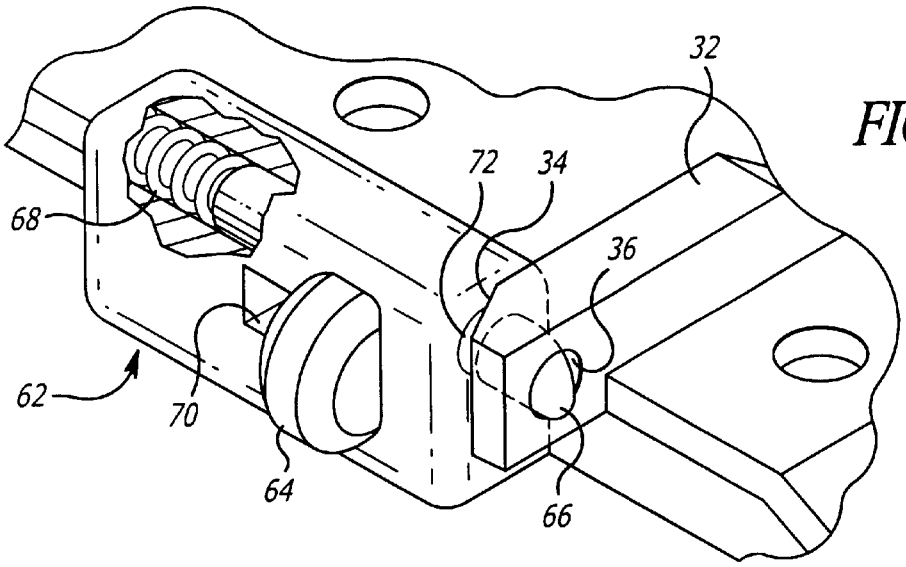
FIG. 7

SNOWBOARD BINDING

BACKGROUND OF THE INVENTION

1. Field of the Invention

The present invention relates generally to a snowboard binding, and particularly to a binding that is designed to releasably engage a bottom plate and binding mechanism mounted to a snowboard, with a top plate mounted in a snowboard boot. Upon entry of the top plate into the bottom plate it is made to dislodge any snow or ice that may be present in bottom plate and binding mechanism, and upon full engagement automatically lock using mechanical means creating a secure connection. This snowboard binding also allows the snowboard rider to engage and disengage this mechanism without compromising a standing position in snowy or icy conditions.

2. Description of the Prior Art

The sport of snowboarding requires that the practitioner have a board for gliding on the snow generally referred to as a snowboard. A binding mechanism is needed to effectively hold a rider to the board, and is generally referred to as a snowboard binding. There are numerous bindings available but none solve all the problems associated with the sport of snowboarding. Snowboard bindings can be best categorized by the varied means of engaging the user's boot to the binding itself. Bindings are either manually operated (requiring the user to tighten a buckle and strap with hands before use), or step-in actuated (engaging by the motion of the foot entering the binding and locking in place at completion of entry.) The binding of the present invention being disclosed is of the step-in variety. All of these bindings vary slightly in mechanical make-up, but are all designed to maintain a positive connection between snowboard and rider. Most of these bindings require the user to wear an particular boot and step directly vertically downwardly onto a base piece mounted on a snowboard's surface. An example of such step-in binding devices is disclosed in U.S. Pat. No. 5,890,730, which requires downward force combined with a side-to-side rocking motion in order to engage and lock the binding mechanism. U.S. Pat. No. 5,971,420 is based on a similar concept, but requires a downward force combined with a toe to heel rocking motion where the toe catches and the heel is lowered locking the mechanism.

The manually operated bindings have straps that go over the tops of the users boot which often creates undue pressure and discomfort upon the users feet. Manual bindings require a user to sit or kneel in the snow while buckling or fastening foot straps. This may also be required to remove obstructive snow while in the same sitting or kneeling position.

Referring, in particular, to these step-in snowboard bindings, these types of bindings are complicated to engage when too much snow is present within the mechanism itself. Usually, such accumulation of snow or other foreign matter within the inner structure of the binding requires the user to, manually remove the foreign matter. The present step-in bindings are relatively expensive when compared to manually operated bindings. The large number of moving parts incorporated into the presently available step-in bindings make them susceptible to mechanical failure due to the amount of stress and pressure inflicted on the binding during the actual sport. The present engagement methods previously mentioned for the step-in bindings, namely downward motion engagement, toe to heel engagement, and side to side engagement, all promote blockage due to snow on or in the base piece mounted to the snowboard surface. This creates a barrier of snow between the users boot and the locking mechanism in the base piece. As a result this often times requires a user to sit or kneel in the snow and manually clear the snow from the binding so that it can be engaged.

Accordingly, with these ever-present problems with the current snowboard binding technology there has been a need for a snowboard binding such as the step-in style binding being disclosed that overcomes these shortcomings.

The binding of the present invention being disclosed is relatively inexpensive, simple to engage (not requiring the users hands) and disengage. The present invention being disclosed is very compact and lightweight. This particular binding permits the user to engage the boot into the base from the side horizontally, not directly down onto the binding. This binding, with its simply design comprising only three moving parts, eliminates all blockages due to obstruction by snow and decreases the chances of mechanical malfunctions by lessening the levels of stress and tension. This is particularly beneficial to users in areas which receive large amounts of snowfall. The convenience and ease of use allow a snowboard rider to remain standing during engagement and release of the mechanism even in deep snow, without any manual preparation or removal of snow, and without compromising a standing position. At the same time the binding ensures that a positive connection has been made that can only be disengaged by the rider acting intentionally and not accidentally.

SUMMARY OF THE INVENTION

One object of invention is to provide a new classification of "step-in" binding which slides in from the side, allowing for easy engagement, creates a positive connection, and automatically locks upon full engagement.

Another object of invention is to provide a snowboard binding that will not malfunction when snow is present in the binding by virtue of the sliding action and design of the locking mechanism, wherein snow and other matter that might accumulate on the base portion is simply pushed out of the base as the top plate of the boot engages with the binding.

Yet another object of invention is to provide a snowboard binding that prevents accidental release but still allows the user to disengage the binding easily and quickly, with the use of only one hand and without compromising a standing position. object of invention A further is to provide a snowboard binding A further object of invention is to provide a snowboard binding that has a minimum number of moving parts and is cost effective to manufacture using the latest technology and materials.

Still another object of invention is to provide a snowboard binding that has an optional orientation of base plate and direction of entry into the binding.

A still further object of invention is to provide a snowboard binding that has variable options for ankle support.

Another object of invention is to provide a snowboard binding that is readily adaptable to all standard snowboards.

These and other objects of the invention are provided by the snowboard binding of the present invention, which is generally rectangular with upper and lower mating components. The upper piece, being the male portion of the snowboard binding, is to be contained on the bottom center surface of a snowboard boot. The lower piece, being the female portion, is to be mounted to the upper surface of a snowboard by conventional means.

The bottom plate's receiving front and rear edges are angled inwardly toward the center at about 45-degrees on each end. There is an aperture pattern centrally located on this bottom plate to allow for mounting to a snowboard. Additionally, this aperture pattern allows user to rotate the bottom plate, horizontally, to any angle that is preferred. The edges of the upper plate are angled upwardly at about a 45-degree angle as to accommodate the outer edges of the bottom plate when in position. Referring to the right and left edges of the bottom plate, a spring loaded locking mechanism is located on the inner edge facing the center of the board. This locking mechanism is designed to be actuated by the top piece sliding into the opposing bottom piece, and then locking the top piece into a fixed position. The edges of the upper plate are angled upwardly by about 45-degree angle as to accommodate the outer edges of the bottom plate when in position. Referring to the right and left edges of the upper plate, a protruding block, located on the same edge as the bottom plate's locking mechanism, receives the bottom plate's spring loaded pin through an aperture on it's beveled edge. This beveled surface pushes against the bottom plate's spring-loaded locking pin, forcing it back and compressing the spring. As the pin of the lock aligns with the aperture in the protruding block of the top plate, the spring decompresses allowing the pin to slide in creating a positive connection. This easily obtained positive connection is the basis of the present invention. To disengage the mechanism, it is required for user to reach down and push back on a lever connected to the pin of the locking mechanism. This backward movement of the lever decompresses the spring and allows the locking pin to be removed from the aperture in which it is located. Releasing the locking pin terminates the connection between the top and bottom plates allowing user to remove feet from the board.

BRIEF DESCRIPTION OF THE DRAWINGS

Characteristics of the invention will be better understood with reference the description below.

FIG. 5 is a top plan view showing an embodiment of the top plate.

FIG. 6 is a section view, taken along lines 6—6 of FIG. 2, showing the top plate and bottom plate.

FIG. 7 is a detailed perspective view showing the locking mechanism located on the bottom plate with the opposing locking component of the top plate being engaged.

DETAILED DESCRIPTION OF THE INVENTION

Figure 1:
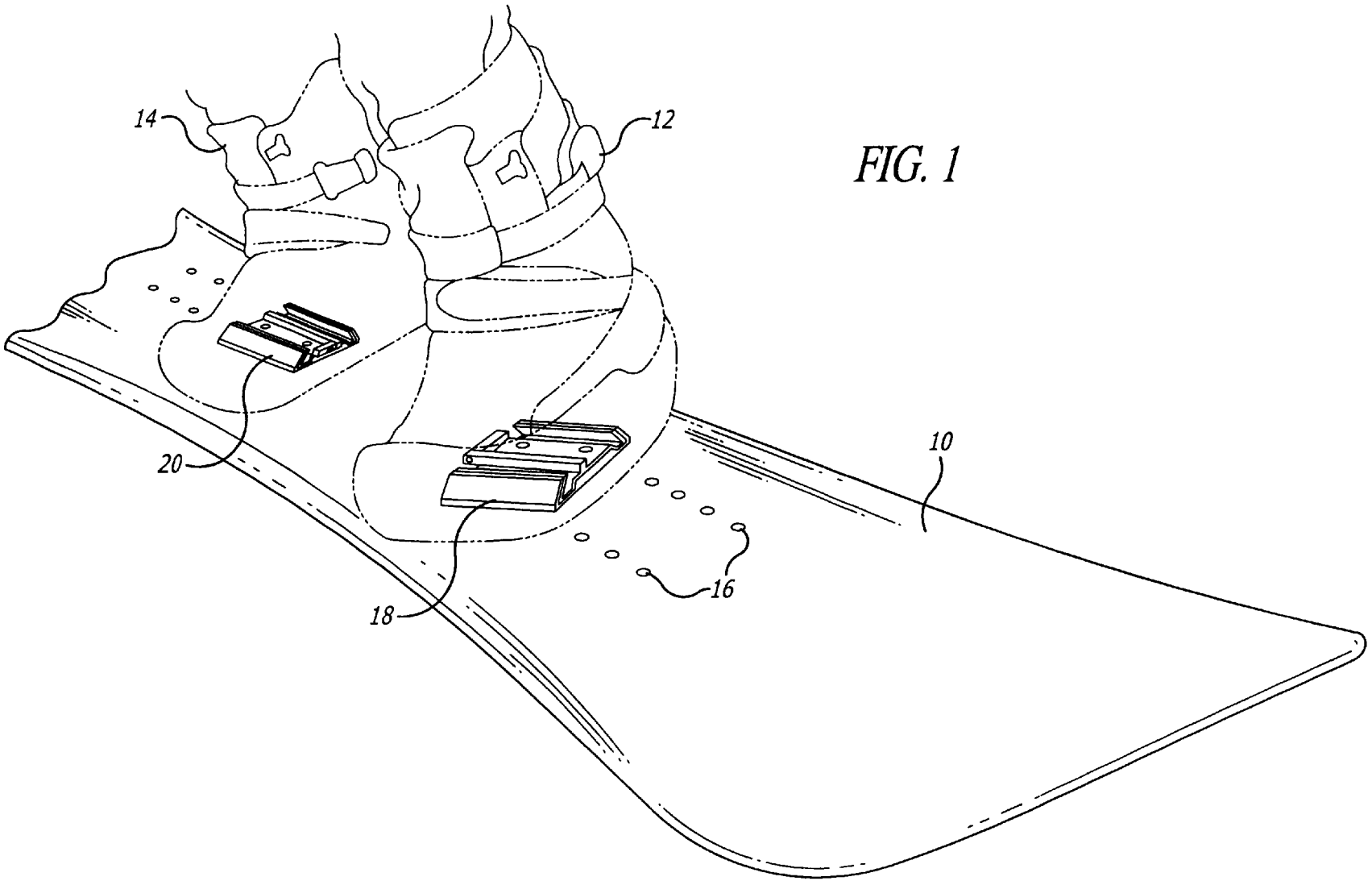
FIG. 1 shows the present invention engaged in a fixed position on a snowboard; with the top piece attached to a snowboard boot (shown in phantom) locked into the bottom piece which is mounted to the upper surface of a snowboard.

FIG. 1 shows snowboard boots 12 and 14 securely attached to snowboard 10 by fully engaged binding assemblies 18 and 20 which are secured to the board by inserting mounting hardware (screws) 22 into threaded mounting holes 16 in the board. The snowboard boots 12 and 14 are shown perpendicular to the long edge of the snowboard 10, which is the most common stance. Aligning the opposing top and bottom pieces of assemblies 18 and 20, and sliding them together to full engagement make engagement.

Figure 2:
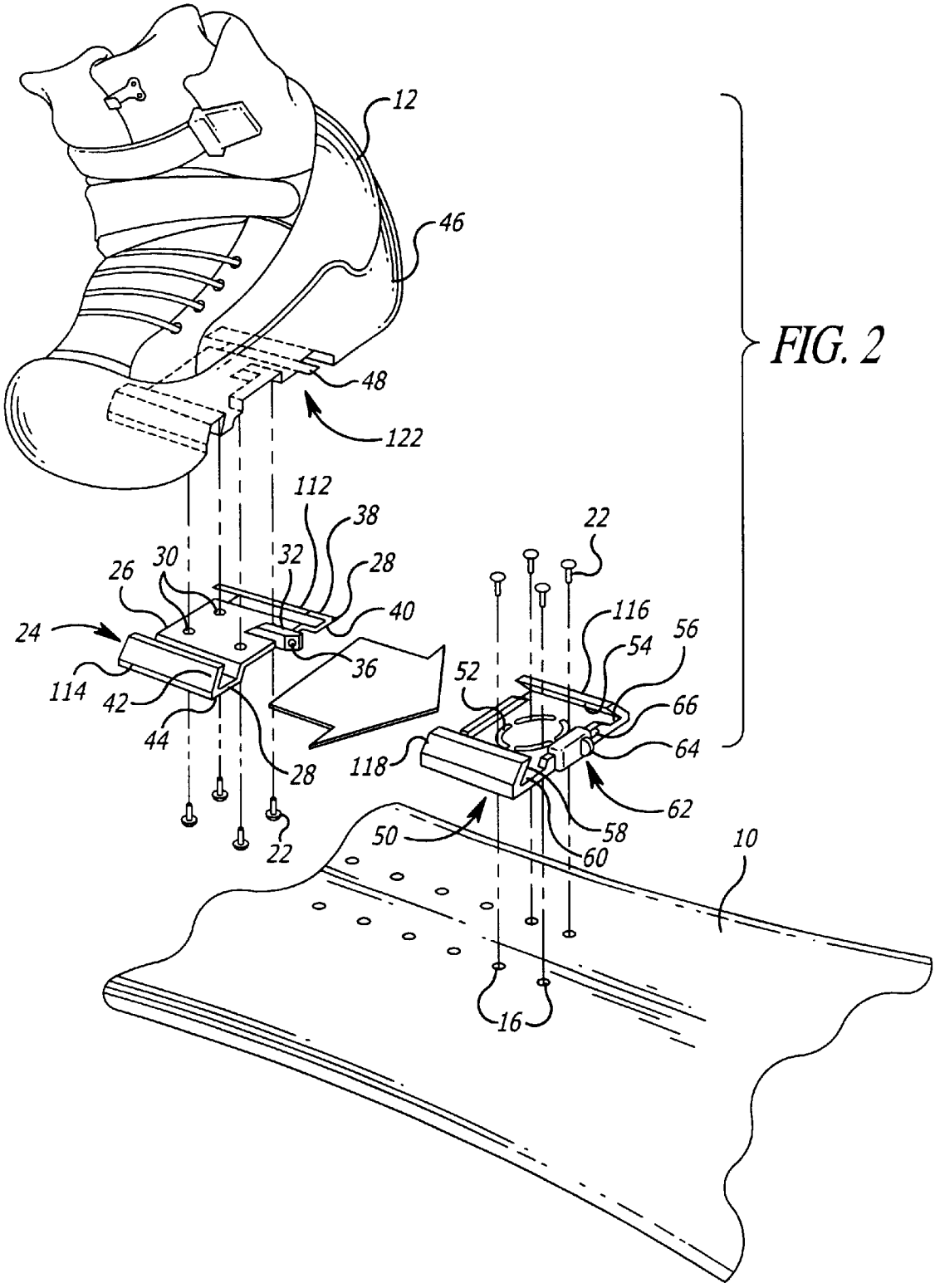
FIG. 2 is an exploded view showing the location of both plates, means of mounting for both plates, and direction of engagement of both plates.

FIG. 2 shows all needed parts and illustrates the direction and orientation of top plate 24 and bottom plate 50 as needed for engaging and locking. FIG. 2 also shows the relationship and means of connection between top plate 24 and snowboard boot 12 as well as the relationship and means of connection of the bottom plate 50 and the snow board 10.

A snowboard boot 12 is shown including a sole 46 and a recessed area 48 in the sole to accommodate the top plate 24 where the top plate 24 will be bolted on with screws or bolts 22 through holes into the snowboard boot's sole 46. When the top plate 24 is in position and held in place with fasteners 22 it is not to move and the bottom of the top plate 24 should preferably be generally flush and level with the bottom of the snowboard boot's sole 46.

The top plate 24 is generally referred to as the male part of the assembly with the base plate 50 being the female or receptor piece. The top plate 24 is generally rectangular in shape with the ends being turned up and angled in toward the center of the part at about 45 degrees creating contact surfaces 38 and 42 on each outside face of upturned ends. Other angles can also be used. Contact surfaces 38, 40, 42, 44 of the top plate 24 make contact with contact surfaces 54, 56, 58, 60, respectively, of the bottom plate 50, making a positive connection between the top plate 24 and bottom plate 50. The top plate 24 and bottom plate 50 are locked into place by use of a locking bar 32 on top plate 24 and locking mechanism 62 of the bottom plate 50. The Locking bar 32 includes a locking hole 36 and a rounded or beveled surface 34 that actuates the locking pin 66 of locking mechanism 62 located on the bottom plate 50. The top plate 24 slides into place with contact surfaces 40 and 44 riding on opposing contact surfaces 56 and 60 of the bottom plate 50. Contact surfaces 38 and 42 of the top plate 24 oppose contact surfaces 54 and 58 of the bottom plate 50 only to maintain the connection by not allowing the two plates to separate in an upward direction. The main body of the top plate 24 is designed in such a fashion as to clear fasteners 22 when sliding into the bottom plate 50. The leading edge 28 of top plate 24 is designed to remove ice and snow as the parts are engaged. The leading edge 28 clears any debris that may be obstructing engagement of plates 24 and 50 by scraping across contact surfaces 54, 56, 58, 60 of bottom plate 50 and removing any foreign matter present.

The bottom plate 50 is rectangular in shape and mimics the top plate 24 in that it has turned up end tabs containing on the inward faces of each tab, and contact surfaces 54, and 60. The bottom plate 50 is shown with locking mechanism 62. The locking mechanism includes a locking pin 66, and a release handle 64. The means of attachment of the bottom plate 50 to the snowboard 10 by fasteners 22 inserted through apertures 52 in bottom plate 50 into threaded receiving holes 16 on the snowboard 10 is shown.

Figure 3:
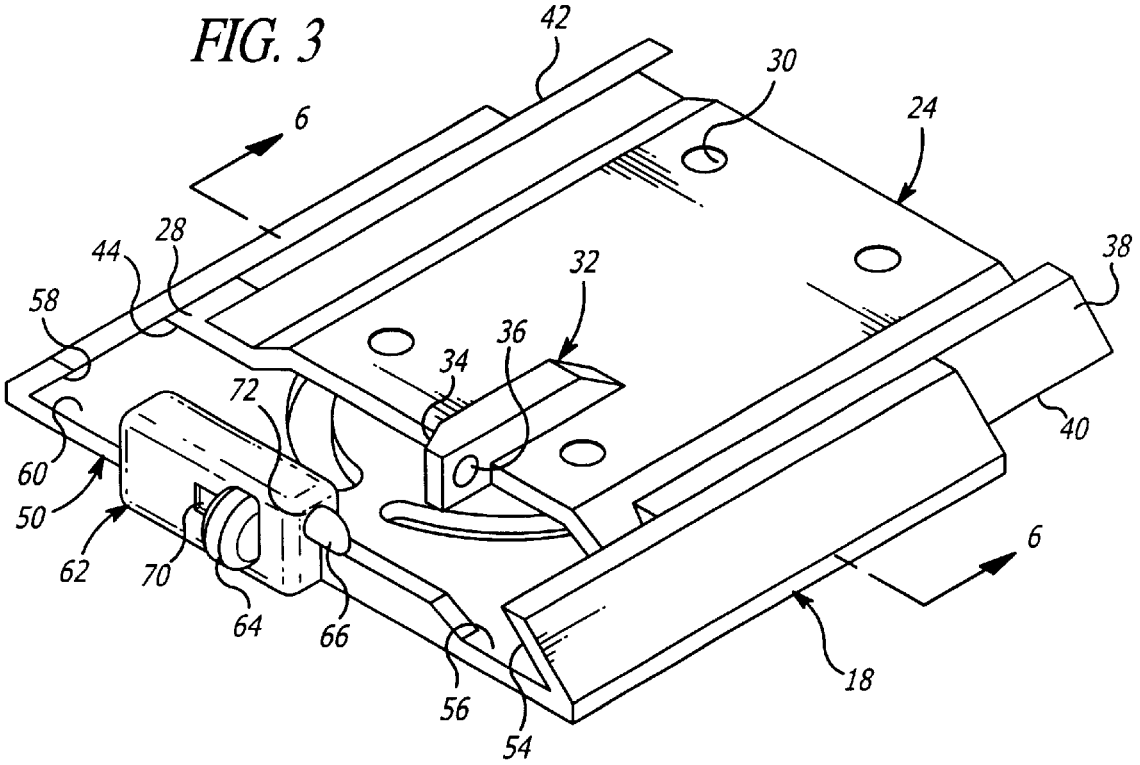
FIG. 3 is a perspective view showing the relation of the two components of the present invention when engaged.

FIG. 3 illustrates the assembly 18 of plates 24 and 50. The top plate 24 is shown sliding into bottom plate 50 with the connection between the two being made by contact surfaces 38, 40, 42, 44 of the top plate 24 against contact surfaces 54, 56, 58, 60, respectively, of the bottom plate 50. This makes for a positive connection that will not allow the top plate 24 to disengage from the bottom plate 50 unless it is traveling in the correct direction. In this embodiment, the locking mechanism 62 of bottom plate 50 and the locking bar of top plate 24 have not achieved full locked position because the top plate 24 and bottom plate 50 are not fully engaged or slid in far enough to engage the lock mechanism 62 and locking bar 32. This view illustrates clearly how the leading edge 28 of top plate 24 will clear snow obstructions on or in the bottom plate 50 as the top plate 24 slides into position.

Figure 4:
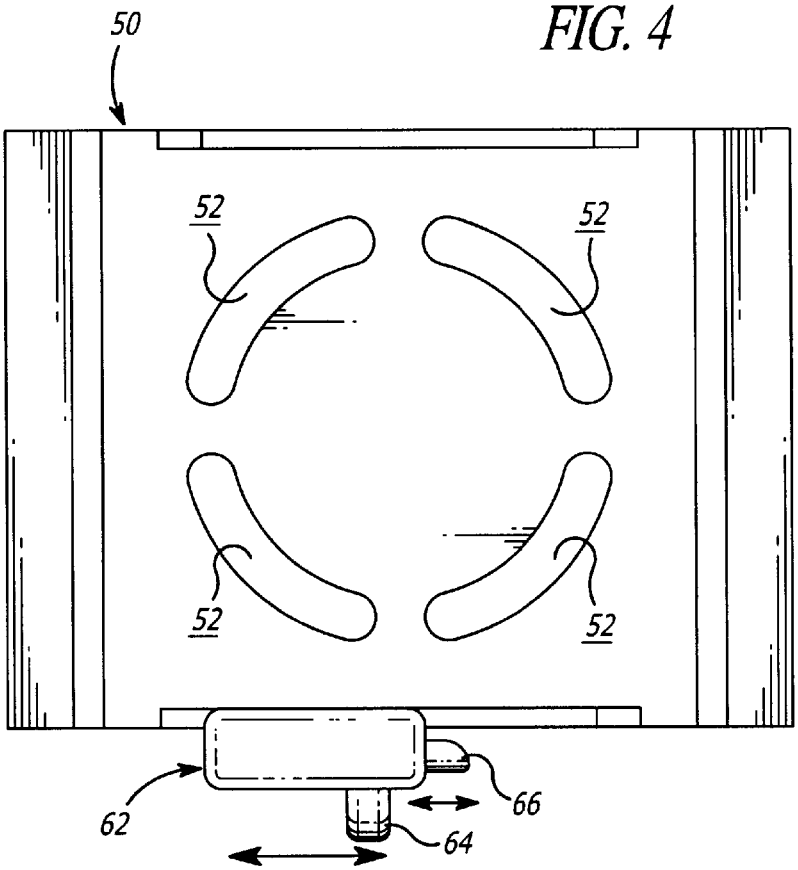
FIG. 4 is a top plan view of the bottom plate.

FIG. 4 is a top plan view of the bottom plate 50. The apertures 52 for mounting the bottom plate 50 with attached locking mechanism 62 to the snowboard 10 are shown. A clearer relation between the bottom plate 50 and the locking mechanism 62 is shown. The locking mechanism 62 is preferably integral with the bottom plate 50.

FIG. 5 is a top plan view of the top plate 24. The holes 30 for securing the top plate 24 to the snowboard boot 12 are shown. The holes 30 pass directly through the body 26 and provide a secure means of fastening top plate 24 to a snowboard boot 12. The location of the locking bar 32 in relationship to the top plate 24 is also shown.

FIG. 6 is a section view taken from FIG. 3 detailing the connection between top plate 24 and bottom plate 50. Shown here are contact surfaces 38, 40, 42, 44 of top plate 24 completely secured by contact surfaces 54, 56, 58, 60, respectively, of the bottom plate 50.

FIG. 7 is an enlarged perspective view of the locking mechanism 62 of the bottom plate 50 and the locking bar 32 of the top plate 24 in a locked position detailing the relationship and function between these parts. As seen here, locking pin 66 is inserted into locking hole 36 of locking bar 32 to maintain the positive connection between top plate 24 and bottom plate 50. The locking mechanism 62 contains a locking pin 66 which is inserted into the pin guide hole 72 which allows the tip of the locking pin 66 to slide in and out of the guide hole 72 by a controlled amount. This guide hole 72 is referred to as a blind hole. The locking mechanism 62 includes a biasing means (e.g. a compression spring) 68 in order to keep tension on the locking pin 66 which in turn maintains the locking engagement between the locking pin 66 and the locking hole 36 of the locking bar 32. The amount of travel of the locking pin 66 is governed by the compression of the spring 68 and the locking handle 64 sliding in slot 70. The locking handle 64 is attached directly to the locking pin 66 through slot 70 located on the outside of the locking mechanism 62. This keeps the locking pin 66 in position and from coming out of the guide hole 72 because of the force exerted by the compression spring 68. The spring tension is also what maintains the locked connection between the locking pin 66 and locking hole 36 of the locking bar 32 of the top plate 24. In order to release the lock, the locking handle 64 is moved rearwardly, which in turn forces the locking pin 66 out of the hole 36. As the top plate 24 is moved forwardly into the bottom plate 50, the bevel 34 will ease the tip of the locking pin 66 until it snaps into hole 66.

Figure 8:
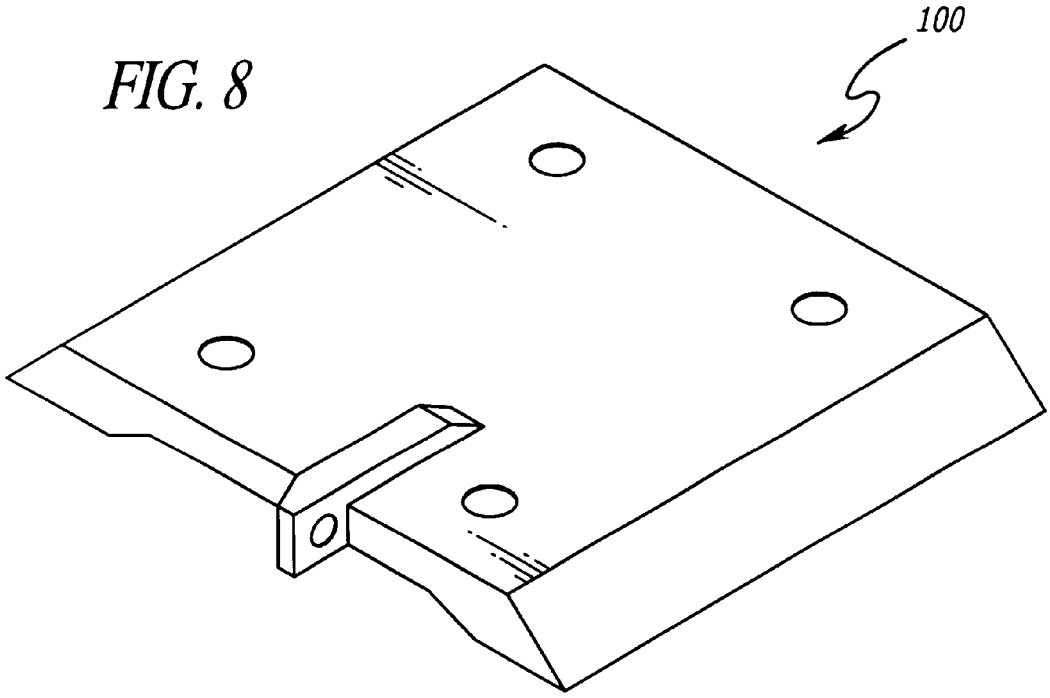
FIG. 8 shows a perspective view of an alternate embodiment for the top plate of the present invention.
Figure 9:
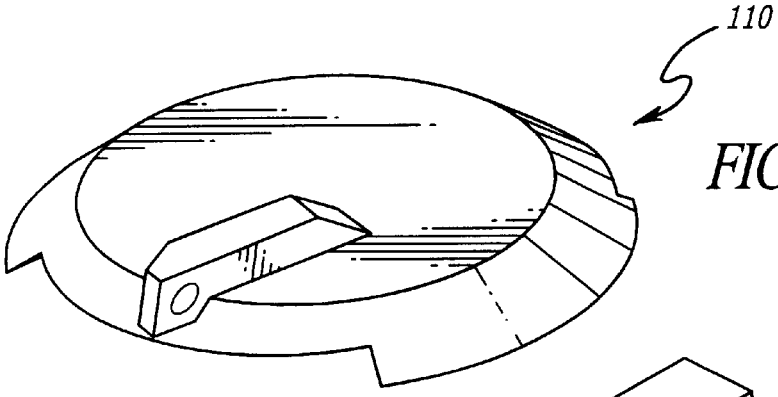
FIG. 9 shows a perspective view of an alternate embodiment for the top plate of the present invention.
Figure 10:
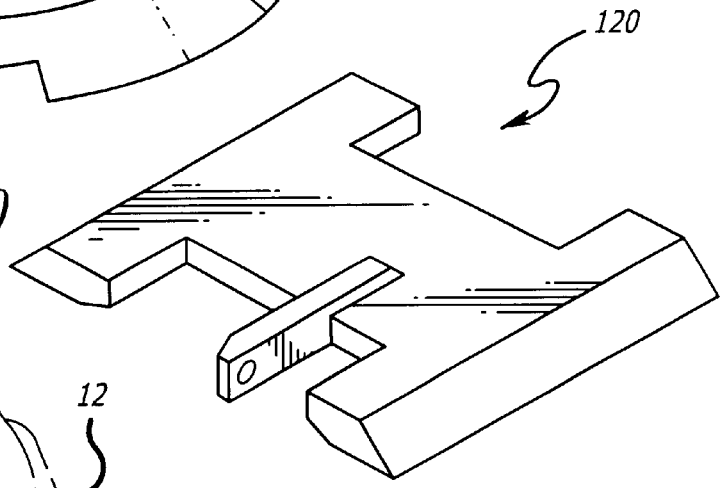
FIG. 10 shows a perspective view of an alternate embodiment for the top plate.

FIGS. 8, 9, and 10 illustrate three alternate embodiments of top plates 100, 110 and 120. These embodiments are similar in function as the embodiment of the top plate 24 shown in FIGS. 1–6, but vary in appearance and the amount of contact surface available for connection.

Figure 11:
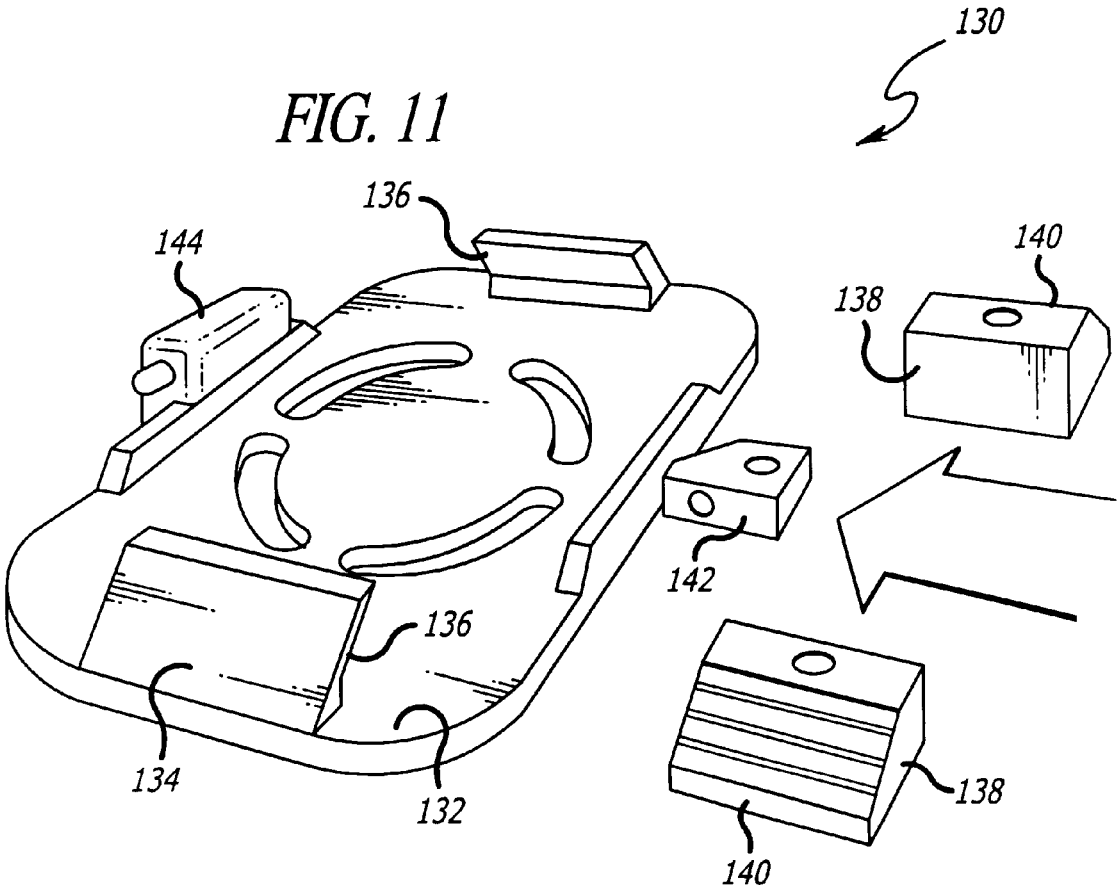
FIG. 11 shows a perspective view of an alternate embodiment for both top and bottom plates of the present invention.

FIG. 11 illustrates an alternate embodiment of the snowboard binding 130, with a bottom plate 132 with inwardly angled ends 134, having inwardly angled surfaces 136. Two separate boot engagement portions 138 have angled outer surfaces 140, and are affixed to a user's boots. A locking portion 142 is also provided for attachment to a user's boot. The boot engagement portions 138 are slidably engagable with the angled ends 134 and the locking portion 142 is lockably detachable to a locking mechanism 144 of the bottom plate 132. The locking mechanism can have the same structure as in the previously described embodiments.

Figure 12:
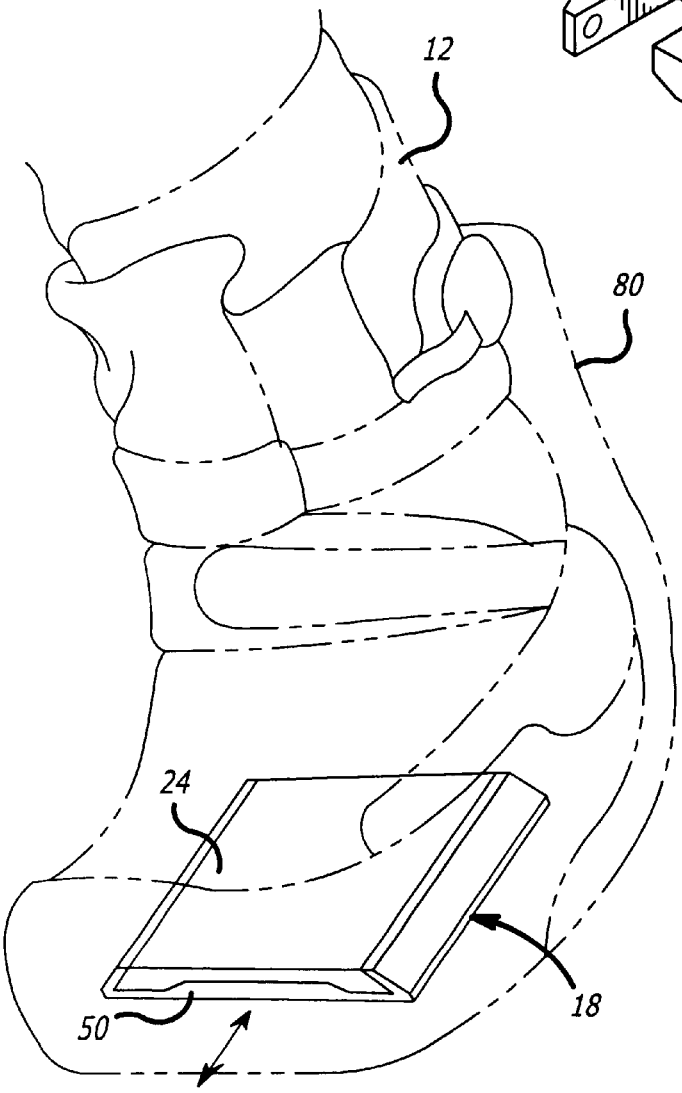
FIG. 12 shows a perspective view of another alternate embodiment in which both plates are oriented differently allowing a boot to slide backwards into an incorporated high back used for ankle support.

FIG. 12 illustrates an alternate embodiment of the snowboard binding where the assembly 18 is oriented a 90 degree turn from its original orientation in FIG. 1. This orientation allows the snowboard boot 12 with attached top plate 24 to slidably engage the bottom plate 50 in front to rear manner (unlike to side-to-side manner of the mounting of FIG. 1), such that the snowboard boot 12 can be supported by an ankle support mechanism or high-back 80 when fully engaged and locked into place.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation.

What is claimed is:

1. A snowboard binding for use with a snowboard and boots, the snowboard binding comprising:

a top plate for affixation to a sole of a boot, the top plate having two parallel spaced apart and opposed slider rails and a locking bar at a front thereof; and a bottom plate for affixation to a snowboard, the bottom plate having two parallel, continuous opposing end tabs defining channels, which channels are sized to slidably receive insertion of the slider rails of the top plate at a rear end of the bottom plate, and a locking mechanism located at a front end of the bottom plate, which locking mechanism is adapted to be detachably engaged with the locking bar.

2. The snowboard binding of claim 1, wherein the two spaced apart and opposed slider rails comprise upturned and inwardly angled end walls having a predetermined angle, and the two opposing end tabs are inwardly angled by a predetermined angle which is complementary to that of the slider rails.

3. The snowboard binding of claim 1, wherein the locking mechanism has a locking pin adapted to be biased into a hole formed in the locking bar when the top plate is fully engaged with the bottom plate.

4. The snowboard binding of claim 3, wherein the locking pin of the locking mechanism includes a biasing spring and a locking handle to move the locking pin out of the hole formed in the locking bar to permit the top plate to be detached from the bottom plate.

5. The snowboard binding of claim 1, wherein the top plate is a unitary structure.

6. The snowboard binding of claim 1, wherein the bottom plate has curved mounting apertures formed therethrough.

7. The snowboard binding of claim 1, further comprising a high back portion to provide further support.

8. The snowboard binding of claim 1, wherein the top plate and the bottom plate are attachable to the boot and snowboard, respectively by screws or bolts.

9. A snowboard binding for use with a snowboard and boots, the snowboard binding comprising:

a top plate for affixation to a sole of a boot, the top plate having two parallel, spaced apart and opposed upturned and inwardly angled end walls, and a locking bar located at a front thereof with a hole formed therein; and a bottom plate for affixation to a snowboard, the bottom plate having two parallel, continuous opposing end tabs defining channels, which channels are inwardly angled by a predetermined angle generally mating to that of the end walls of the top plate to slidably receive insertion of the end walls of the top plate at a rear end of the bottom plate, and a locking mechanism located at a front end of the bottom plate with a locking pin adapted to be biased into the hole formed in the locking bar when the top plate is fully engaged with the bottom plate.

10. The snowboard binding of claim 9, wherein the locking pin of the locking mechanism includes a biasing spring and a locking handle to move the locking pin out of the hole formed in the locking bar to permit the top plate to be detached from the bottom plate.

11. The snowboard binding of claim 9, wherein the top plate is a unitary structure.

12. The snowboard binding of claim 9, wherein the bottom plate has curved mounting apertures formed therethrough.

13. The snowboard binding of claim 9, wherein the top plate and the bottom plate are attachable to the boot and snowboard, respectively by screws or bolts.

14. A snowboard binding system, comprising:

a snowboard boot having a sole with a relief formed therein;

a top plate for affixation to the relief formed on the sole of the boot, the top plate having two parallel spaced apart and opposed slider rails and a locking bar at a front thereof; and a bottom plate for affixation to a snowboard, the bottom plate having two parallel, continuous opposing end tabs defining channels, which channels are sized to slidably receive insertion of the slider rails of the top plate at a rear end of the bottom plate, and a locking mechanism, located at a front end of the bottom plate which locking mechanism is adapted to be detachably engaged with the locking bar.

15. The snowboard binding system of claim 14, wherein the two spaced apart and opposed slider rails comprise upturned and inwardly angled end walls having a predetermined angle, and the two opposing end tabs are inwardly angled by a predetermined angle.

16. The snowboard binding system of claim 14, wherein the locking mechanism has a locking pin, biasd with a biasing spring, and a locking handle to move the locking pin out of a hole formed in the locking bar to permit the top plate to be detached from the bottom plate.

17. The snowboard binding system of claim 14, wherein the top plate is a unitary structure.

* * * * *